US010941906B2

(12) United States Patent
Wondergem-De Best et al.

(10) Patent No.: US 10,941,906 B2
(45) Date of Patent: Mar. 9, 2021

(54) LIGHTING MODULE

(71) Applicant: SIGNIFY HOLDING B.V., Eindhoven (NL)

(72) Inventors: Anna Wilhelmina Maria Wondergem-De Best, Veldhoven (NL); Ties Van Bommel, Horst (NL); Simon Jacobus Maria Kuppens, Geldrop (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/632,364

(22) PCT Filed: Jul. 16, 2018

(86) PCT No.: PCT/EP2018/069290
§ 371 (c)(1),
(2) Date: Jan. 19, 2020

(87) PCT Pub. No.: WO2019/016150
PCT Pub. Date: Jan. 24, 2019

(65) Prior Publication Data

US 2020/0208789 A1 Jul. 2, 2020

(30) Foreign Application Priority Data

Jul. 20, 2017 (EP) ..... 17182265

(51) Int. Cl.
*F21K 9/232* (2016.01)
*F21V 29/76* (2015.01)
(Continued)

(52) U.S. Cl.
CPC ..... *F21K 9/232* (2016.08); *F21K 9/65* (2016.08); *F21K 9/66* (2016.08); *F21V 29/767* (2015.01);
(Continued)

(58) Field of Classification Search
CPC ... F21K 9/232; F21K 9/65; F21K 9/66; F21V 14/06; F21V 29/767; F21Y 2107/30;
(Continued)

(56) References Cited

U.S. PATENT DOCUMENTS 6,343,871 B1 * 2/2002 Yu ..... G09F 13/04 362/249.03
9,909,727 B2 * 3/2018 Martin ..... F21S 43/26
(Continued)

FOREIGN PATENT DOCUMENTS

EP 1950490 A2 7/2008
EP 2886944 A1 6/2015
(Continued)

*Primary Examiner* — Zheng Song
(74) *Attorney, Agent, or Firm* — Daniel J. Piotrowski

(57) ABSTRACT

A lighting module (1) for connecting to a luminaire, the lighting module extending along a longitudinal axis (LA) and comprising: a base (3) for connecting the lighting module (1) to a socket (11) of the luminaire (10); a central body (4) carrying at least a first light source (21) and a second light source (22), wherein the first light source (21) is configured to emit first light having a first light distribution with a first main direction pointing away from the longitudinal axis (LA), and the second light source (22) is configured to emit second light having a second light distribution with a second main direction pointing away from the longitudinal axis (LA), the first and second main directions being different from one another; and an optical element (6) including at least one optical portion (61) and a cover portion (62) extending all around the central body (4) and said optical element (6) being rotatable about the longitudinal axis (LA) in relation to the central body (4), the at least one optical portion (61) having an optical property, such that the optical portion (61) is configured to affect light emitted from at least one of the light sources, the at least one optical portion (61) extends in an angular area around the
(Continued)

longitudinal axis (LA), and the cover portion (62) is configured not to affect light emitted from the remaining sources.

15 Claims, 6 Drawing Sheets

(51) Int. Cl.

| | |
|---|---|
| ***F21K 9/66*** | (2016.01) |
| ***F21K 9/65*** | (2016.01) |
| *F21Y 105/16* | (2016.01) |
| *F21Y 115/10* | (2016.01) |
| *F21Y 107/50* | (2016.01) |
| *F21V 14/06* | (2006.01) |

(52) U.S. Cl.
CPC ..... *F21V 14/06* (2013.01); *F21Y 2105/16* (2016.08); *F21Y 2107/50* (2016.08); *F21Y 2115/10* (2016.08)

(58) Field of Classification Search
CPC ..... F21Y 2107/50; F21Y 2115/10; F21Y 2105/16; F21W 2131/103
See application file for complete search history.

(56) References Cited

U.S. PATENT DOCUMENTS

| | | | | |
|---|---|---|---|---|
| 2009/0168425 | A1* | 7/2009 | Chuang | F21K 9/232 362/284 |
| 2012/0026732 | A1* | 2/2012 | Fricke | F21V 14/02 362/231 |
| 2012/0080994 | A1 | 4/2012 | Chin et al. | |
| 2012/0236535 | A1* | 9/2012 | Parker | F21K 9/64 362/84 |
| 2012/0313500 | A1* | 12/2012 | Breidenassel | F21V 14/04 313/46 |
| 2013/0107513 | A1 | 5/2013 | Lundberg et al. | |
| 2014/0198495 | A1* | 7/2014 | Hu | F21K 9/65 362/235 |
| 2014/0268744 | A1* | 9/2014 | Nourbakhsh | F21V 3/049 362/235 |
| 2015/0036333 | A1* | 2/2015 | Tsuei | F21K 9/66 362/235 |
| 2015/0241042 | A1 | 8/2015 | Berends | |
| 2015/0369430 | A1* | 12/2015 | Vamberi | F21V 5/08 362/235 |
| 2016/0215943 | A1* | 7/2016 | Martin | F21V 9/08 |
| 2016/0230938 | A1* | 8/2016 | Chang | F21K 9/232 |
| 2018/0100642 | A1* | 4/2018 | Hall | F21K 9/23 |
| 2018/0106461 | A1* | 4/2018 | Hall | F21V 14/08 |
| 2020/0248893 | A1* | 8/2020 | Jeon | F21K 9/65 |

FOREIGN PATENT DOCUMENTS

| | | | | |
|---|---|---|---|---|
| GB | 2469790 | * | 3/2010 | F21S 8/00 |
| JP | 2004296249 | A | 10/2004 | |
| JP | 2009016058 | A | 1/2009 | |
| JP | 2009106258 | A | 5/2009 | |
| JP | 2012015012 | A | 1/2012 | |
| JP | 2014167896 | A | 9/2014 | |

* cited by examiner

LIGHTING MODULE

CROSS-REFERENCE TO PRIOR APPLICATIONS

This application is the U.S. National Phase application under 35 U.S.C. § 371 of International Application No. PCT/EP2018/069290, filed on Jul. 16, 2018, which claims the benefit of European Patent Application No. 17182265.3, filed on Jul. 20, 2017. These applications are hereby incorporated by reference herein.

FIELD OF THE INVENTION

The invention relates to a lighting module for replacing gas-discharge lamps of an existing gas-discharge luminaire.

BACKGROUND OF THE INVENTION

Gas-discharge lamps, especially High Pressure Sodium (HPS) arc lamps, are widely used for road and residential lighting, decorative floodlighting, commercial and industrial applications, and recreational sports facilities that are both indoor and outdoor. Such lamps are usually elongated, comprise a bright arc which emits light in a radially omnidirectional way and is placed in the optical center of a reflector of a luminaire which collects and redirects the light to, for example, a road. The high brightness property and the high lumen output of such lamps make them well suited for illuminating big outdoor areas such as roadways, parking lots, and pavements.

Nevertheless, one of the major issues with gas-discharge lamps is their high power consumption, which along with a limited lifetime make them costly in terms of use of electricity and continuous replacement. Furthermore, such lamps may suffer from poor color rendering as their emission spectrum is often limited by the emission spectrum of the gas inside the lamp. Thus, there is a wish to replace such lamps with more energy-efficient alternatives.

To this end, various LED (Light Emitting Diode) configurations have been proposed to replace these high brightness—high lumen output lamps. LED lamps have a much more efficient lumen to power ratio than gas-discharge lamps and also have a longer life time before the lamp needs replacing. However, because gas-discharge lamps are widely used in urban infrastructure such as street light luminaires which would be costly to replace, the LED replacement should be capable of operating in the already existing luminaires. Therefore, the proposed LED replacements should be compatible with the existing luminaires, i.e. be compatible with the existing socket and mimic the radial omnidirectional light emission of the gas-discharge lamps such that the light emitted from a replacement LED lamp is reflected properly when the LED lamp is positioned in the optical center of the reflector of the luminaire.

To provide an LED lamp with a light intensity distribution which resembles that of the existing gas-discharge lamps, in the prior art an LED lamp with a hexagonally shaped central body has been developed, where each side of the hexagonally shaped central body comprises an LED light source, such that the light emitted by the LED lamp somewhat resembles the omnidirectional light of a gas-discharge lamp. The LED lamp is made to be elongated, such that the shape of the LED lamp mimics the shape of a gas-discharge lamp.

An example of such an LED lamps is found in the document KR968270B1 which relates to LED lamp for a street light, where LEDs have been arranged on the surfaces of an elongated hexagonal heatsink.

However, replacing the existing gas-discharge lamps with such LED lamps present some issues. To achieve the required lumen output the heat sink of the LED lamp need to be of considerable dimensions such that the heat produced by the LEDs have sufficient surface area to dissipate from. Accordingly, the overall light source of an LED lamp will have a larger diameter than the light source of a gas-discharge lamp. This entails that the light distribution of an LED lamp mounted in a luminaire designed for a gas-discharge lamp does not match the light distribution of the gas-discharge lamp and generally have a poor and uneven light distribution.

A further issue arises as the mounting sockets used for the gas-discharge lamps are not designed to take the final, mounted orientation of the lamp into consideration as the light distribution of gas-discharge lamps are mostly continuously rotationally symmetric about their longitudinal axis. For the light distribution of LED lamps which, due to their polygonal cross-section, are only discretely rotationally symmetric about their longitudinal axis, the surfaces of the heat sink may end up with a final, mounted position, wherein the surfaces of the heat sink are orientated in a non-optimal manner in relation to the reflector and the light window of the reflector.

In this disclosure, the term "light distribution" of a light source is understood to mean the radial luminous intensity distribution of a light source in relation to an axis, e.g. a longitudinal axis.

In JP 2004 296249 a luminaire is disclosed comprising an LED module having a plurality of LED elements mounted on a mounting board for emitting light toward a reflecting surface. The LED module is installed in the nearly cup-like reflecting surface 1 and is provided with a nearly tubular lens unit.

In JP 2009 016058 an illumination device is provided in which color temperature of illumination light can be varied sequentially, in which there is less use amount of a phosphor, and which is compact even though it has a plurality of semiconductor light emitting elements. The illumination device is equipped with a light-emitting body and a variable color member which is arranged relatively movably against the light-emitting body.

SUMMARY OF THE INVENTION

It is therefore the object of the invention to provide a lighting module and a method for direct replacement of conventional high brightness gas-discharge lamps without modification of the associated luminaire, where the lighting module mitigates at least some of the above mentioned drawbacks.

This is achieved according to a first aspect of the invention relating to a lighting module and according to a second aspect of the invention relating to a method.

According to the first aspect of the invention a lighting module for connecting to a luminaire, the lighting module extending along a longitudinal axis and comprising:

a base for connecting the lighting module to a socket of the luminaire;

a central body carrying at least a first light source and a second light source, wherein the first light source is configured to emit first light having a first light distribution with a first main direction pointing away from the longitudinal axis, and the second light source is configured to emit second light having a second light distribution with a second main direction pointing away from the longitudinal axis, the first and second main directions being different from one another; and an optical element rotatable about the longitudinal axis in relation to the central body and including at least one optical portion having an optical property, such that the optical portion is configured to affect light emitted from at least one of the light sources, the at least one optical portion extends in an angular area around the longitudinal axis.

The lighting module may generally be elongated such that it mimics the shape of a traditional gas-discharge lamp. The longitudinal axis may extend from the center of an end of the base and along the extent of the lighting module. In the case of an oblong lighting module, the longitudinal axis extends along the extent of the lighting module. The lighting module may be symmetric, e.g. discretely rotational symmetric, around the longitudinal axis.

The base of the lighting module may be any base that fits into a socket type of a traditional gas-discharge lamps. These socket types include, but are not limited to, Edison screw sockets or bayonet sockets. E.g., the socket type is a E27 or E40 Edison screw socket. This has the advantage of allowing a lighting module according to the invention to be retrofitted in already existing luminaires. The base is adapted to transfer electricity from the socket to the light sources. The base may comprise electronics adapted to control the light sources, such as when using LEDs as light sources.

Each light source is configured to emit light having a light distribution with a main direction. Even though light emitted from a light source may have many different directions, the light distribution of the light source usually has some degree of directionality. Usually a light source, such as a light emitting diode, has directionality where the main direction has an angle of 90° in relation to the surface on which is it is attached. By providing a lighting module with a plurality of light sources emitting light radially around a longitudinal axis in different directions, the lighting module will somewhat mimic the radial omnidirectionality of traditional gas-discharge lamps. However, since a large number of directional light sources are required for the resulting light distribution to be perfectly omnidirectional, an optical element is provided to improve the light distribution of the lighting module. Each light source may include a plurality of sub light sources each having similar orientation and located in a similar angular area along the longitudinal axis. These sub light sources may be arranged in at least one row along the longitudinal axis, and may e.g. be arranged in two rows.

The optical element is rotatable about the longitudinal axis in relation to the central body, such that adjustments of the orientation of the optical element in relation to the central body is allowed. This has the advantage that it allows adjusting the angular orientation of the optical element when the lighting module is fitted in an existing luminaire, where the resulting angular orientation of the central body, and therefore of the light sources around the longitudinal axis, in relation to the luminaire, is unknown, and thereby provide an improved light distribution.

The optical element extends in an angular area around the longitudinal axis, which may be less than a full revolution around the longitudinal axis. In some embodiments, the optical element extends in an angular area being chosen from the ranges in the group of 1°-180°, 10°-150°, 30°-135°, 45°-120°, and 45°-90°. In some embodiments, the at least one optical portion extends in an angular area of 60° around the longitudinal axis.

The optical property of the at least one optical portion causes the optical portion to affect, e.g. deflect, light emitted from at least one of the light sources. The optical property of the at least one optical portion may cause the optical portion to affect, e.g. deflect, light emitted from at least one of the light sources in a plane perpendicular to the longitudinal axis.

In this disclosure the term "perpendicular to the longitudinal axis" should be understood as substantially perpendicular to the longitudinal axis, i.e. perpendicular within ±30°, preferably within ±20°, more preferably within ±10°.

In some embodiments, the optical element comprises a plurality of optical portions each extending in different angular areas around the longitudinal axis and each having at least one optical property. The optical portions may be located adjacent to each other or they may be located at a distance to each other. The angular areas may have the same extent, or they may be different. The angular areas for these additional optical portions may be chosen for the same ranges as for the above angular area of the first optical portion. Each optical portion may deflect the light of a single light source, or it may deflect the light of a plurality of light sources. A plurality of optical portions may deflect the light of the same light source. In some embodiments, the optical element comprises a number of optical portions extending in different angular areas around the longitudinal axis, said number being chosen from the group of 2, 3, 4, 5, and 6.

In some embodiments, the optical element comprising a plurality of optical portions each configured to deflect light in a plane perpendicular to the longitudinal axis.

In some embodiments, in case of two optical portions, i.e. a first optical portion and a second optical portion, the optical portions extend in an equal angular area, such that the angular areas have the same extent. The optical portions may extend all around the longitudinal axis, e.g. the first portion may extend from 0° to 180° around the longitudinal axis and the second portion may extend from 180° to 360° around the longitudinal axis.

In some embodiments, in case of two optical portions, i.e. a first optical portion and a second optical portion, the extent of each of the optical portions are different from the other, such that the angular areas of the optical portions have a different extent. The optical portions may extend all around the longitudinal axis, e.g. the first portion may extend from 0° to 90° around the longitudinal axis and the second portion may extend from 90° to 360° around the longitudinal axis.

It should be understood that the above considerations regarding angular areas refer to a given cross section of the lighting module through the central body.

In some embodiments, each optical portion(s) of the optical element has at least one optical property chosen from the group of collimation, refraction, reflection, transparency, translucency, deflection, and diffraction. In some embodiments, an optical portion has the collimation property, such that the optical portion is configured to collimate light in a plane perpendicular to the longitudinal axis. In other embodiments, all optical portions are configured to collimate light in a plane perpendicular to the longitudinal axis. In this disclosure, the term "collimate" is understood to mean that rays of light entering an optical portion is more parallel upon exiting. The term should not necessarily be understood as to make rays of light perfectly parallel.

In some embodiments, an optical portion has the deflection property. The optical portion may in these embodiments be configured to deflect light in a plane perpendicular to the longitudinal axis.

In some embodiments, an optical portion has the refraction property. The optical portion may in these embodiments be configured to refract light in a plane perpendicular to the longitudinal axis. The optical portion may in these embodiments be a lens or a lens array. Alternatively, the optical portion is a grating configured to increase the angle between the affected light and the direction of gravity when the lighting module is in an installed condition.

In some embodiments, an optical portion has the reflection property. The optical portion may in these embodiments be configured to reflect light in a plane perpendicular to the longitudinal axis. The optical portion may in these embodiments be a reflector.

In some embodiments, an optical portion has the transparent property. The optical portion may in these embodiments be configured to allow all of the light emitted from at least one light source through the optical portion.

In some embodiments, an optical portion has the translucent property. The optical portion may in these embodiments be configured to only allow part of the light emitted from at least one light source through the optical portion.

In some embodiments, an optical portion has the diffraction property, such that the optical portion is configured to diffract light in a plane perpendicular to the longitudinal axis. The optical portion may in these embodiments be a reflector.

In some embodiments, wherein the optical element comprises a plurality of optical portions, the at least one optical property of each optical portion is different from each other. For instance, the optical property of a first optical portion is different from the optical property of a second optical portion.

The above embodiments relating to the optical property of an optical portion provides the advantage that the resulting light distribution may be further improved.

In some embodiments, the optical element comprises a cover portion adjacent to the optical portion(s) and extending in a second angular area around the longitudinal axis. In some embodiments, the optical element comprises a plurality of cover portions adjacent to the optical portion(s) and extending in different angular areas around the longitudinal axis. In some embodiments, the cover portion(s) is/are configured to not optically affect light emitted from the light sources. The cover portion provides the advantage of protecting the central body and the light sources, improving the durability of the lighting module, mainly without affecting the emission of light.

In some embodiments, the optical element, including the cover portion, extends all around the central body in a plane perpendicular to the longitudinal axis. By providing the optical element to extend all around the central body, the durability of the lighting module is further improved.

In some embodiments, each light source is configured to emit light having a light distribution with a main direction forming an angle with a plane, which includes the longitudinal axis and the light source, said angle being less than or equal to an angle chosen from the group of 45°, 30°, 25°, 10°, 5° and 0°. The case of an angle of 0° corresponds to the main direction being perpendicular to the longitudinal axis.

In some embodiments, each main direction of light emitted from a plurality of light sources may form different angles.

In some embodiments, each light source is configured to emit light having a light distribution with a main direction which is perpendicular to the longitudinal axis. This provides the advantage that the light distribution of the lighting module in a reflector more closely mimics the light distribution of a traditional gas-discharge lamp in this reflector.

In some embodiments, the central body comprises a heat sink configured to transfer and dissipate heat from the light sources. The heat sink may be provided with cooling fins which may be arranged radially. The heat sink may extend in a direction along the longitudinal axis, opposite of the base.

In some embodiments, the heat sink comprises a heat pipe. The heat pipe further improves the thermal management and cooling of the light sources.

In some embodiments, the light sources are LED light sources. LED have a light distribution with a main direction, the main direction is substantially perpendicular to the surface onto which the LED is mounted. An advantage of using LEDs as light sources are the high luminous efficacy of LEDs.

In some embodiments, the lighting module comprises a driver for driving the light sources, e.g. LEDs. This provides the advantage that the driver can adapt the current-voltage (IV) characteristics of the luminaire to suitable current-voltage (IV) characteristics for driving the light sources, e.g. LEDs, of the lighting module.

In some embodiments, the light sources are located at a distance from the longitudinal axis less than the maximum outer radius of the central body. The outer radius of the central body may mimic the shape of a traditional gas-discharge lamp. The light sources may be located at a fraction of the maximum outer radius of the central body, said fraction chosen from the group of 0.9, 0.8, 0.7, 0.6, 0.5, 0.4, and 0.3.

In some embodiments, the central body comprises a slender portion carrying the light sources, and a thick portion, wherein the slender portion has a smaller diameter than the thick portion. The central body may comprise a connecting portion which connects slender portion with the thick portion, the connecting portion may have a truncated cone shape.

These embodiments provide that advantage that the lighting module may be provided in a size that is more similar to traditional gas-discharge lamps, further improving the applicability of the lighting module for replacing traditional gas-discharge lamps.

In some embodiments, the lighting module is configured to allow fixing the orientation of the optical element in relation to the central body. This prevents accidentally changing the orientation of the optical element, such that the light deflection of an installed lighting module is ensured to remain constant after installation in a luminaire.

In some embodiments, the central body carries a number of light sources, each emitting light with a different main direction, said number being e.g. chosen from the group of 3, 4, 5, and 6. Generally, when providing more light sources the overall light distribution of the lighting module becomes more radial omnidirectional, and the closer the installed lighting module mimics the light distribution of a traditional gas-discharge lamp in a reflector.

In some embodiments, a longitudinal portion of the central body carrying light sources has a polygon shape and potentially has as many sides as the number of light sources, wherein each light source is attached to a different side of the central body.

In some embodiments, the optical element comprises a plurality of optical portions each affecting light from a different light source.

In some embodiments, the optical element has a center of gravity displaced from the longitudinal axis and the optical element is seated with a loose fit, thereby allowing gravity to rotate the optical element around the longitudinal axis when the lighting module is in a position in which the longitudinal axis is not vertical.

In some embodiments, the optical element has a center of gravity displaced from the longitudinal axis and the optical element is seated with a loose fit, thereby allowing gravity to rotate the optical element around the longitudinal axis when the lighting module is in a position in which the longitudinal axis is horizontal.

In some embodiments, a luminaire comprises a socket, a reflector, and a lighting module according to the first aspect of the invention, wherein the lighting module is connected to the socket. The longitudinal axis is in an embodiment coinciding with an optical center of a reflector of the luminaire.

In the second aspect, the present invention relates to a method for installing a lighting module according to the invention in a luminaire, comprises the steps of:

providing a luminaire with a socket and a lighting module according to the first aspect of the invention, connecting the base of the lighting module to the socket, adjusting the angular orientation of the optical element in relation to the central body to provide the desired light distribution by rotating the optical element around the longitudinal axis.

In some embodiments of this method, the method is for retrofitting a lighting device according to the first aspect of the invention in an existing luminaire, wherein the method comprises the step of removing an existing bulb connected to the socket, before the step of connecting the base of the lighting module to the socket. This provides the advantage of allowing retrofitting a lighting module according to the first aspect of the invention to an existing luminaire.

In some embodiments of this method, after the step of adjusting the angular orientation of the optical element in relation to the central body, the method comprises a step of fixing the orientation of the optical element in relation to the central body. This prevents accidentally changing the orientation of the optical element, such that the light deflection of an installed lighting module is ensured to remain constant after installation in a luminaire. Any and all of the above aspects of the invention and embodiments may be combined with each other as desired.

BRIEF DESCRIPTION OF DRAWINGS

In the following the invention will be described in more detail with reference to the drawing, where.

DETAILED DESCRIPTION OF EMBODIMENTS

Figure 1A:
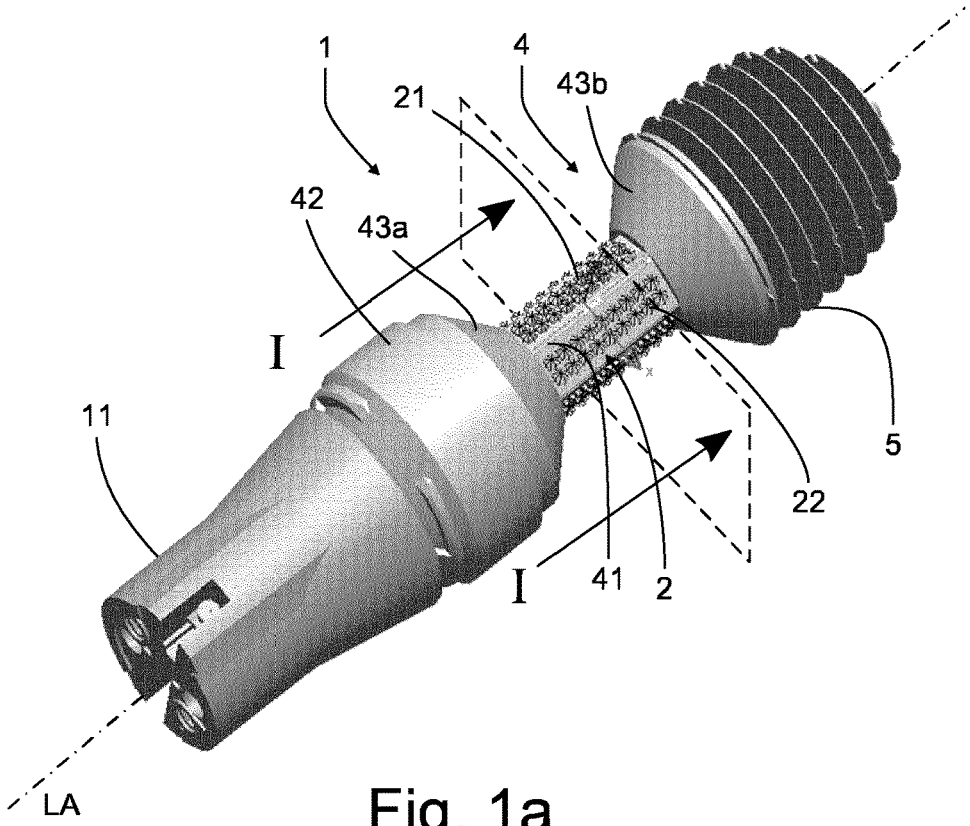
FIG. 1*a* is a perspective view of a lighting module connected to a socket.

FIG. 1*a* show a lighting module 1 for connecting to a luminaire of which only a socket 11 is shown. The lighting module 1 is here shown mounted in the socket 11. The lighting module 1 extends along a longitudinal axis LA, which extends through the center of the socket 11. The lighting module 1 comprises:

a base (not shown) for connecting the lighting module to a socket 11 of the luminaire, in FIG. 1*a* the base not visible as it is mounted inside the socket 11;

a central body 4 carrying a plurality of light sources 2 including a first light source 21 and a second light source 22. The central body 4 comprises a slender portion 41, a thick portion 42, a first connecting portion 43*a* and a second connecting portion 43*b*. The slender portion 41 has a hexagonal shape. The connecting portions 43*a*, 43*b* have a truncated cone shape. The light sources 21 and 22 are attached to respective sides of the slender portion 41 which extends along the longitudinal axis LA. Additional light sources 2 are attached to the remaining sides of the slender portion 41. The base is connected to the thick portion 42 of the central body 4. The first connecting portion 43*a* connects the thick portion 42 with the slender portion 41. The central body 4 further includes a heat sink 5 configured to transfer and dissipate heat from the all the light sources. The heat sink 5 is connected to slender portion 41. The heat sink 5 has cooling fins which are located at the opposite end of the lighting module 1 from the base along the longitudinal axis LA. The slender portion 41 has a smaller diameter than both the thick portion 42 and the cooling fins of the heat sink 5.

The first light source 21 is configured to emit light having a first light distribution with a first main direction at an 90° angle to the longitudinal axis LA. The second light source 22 is configured to emit light having a second light distribution with a second main direction at a 90° angle to the longitudinal axis LA. The first and second main directions are different from one another. The light sources 21, 22 are each shown to be provided as two rows of ten LEDs, where the rows extend along the longitudinal axis. The LEDs of each light source have a light distribution with a main direction at an angle of 90° to the longitudinal axis LA. The main direction of the light sources 2 is coinciding with the normal of the surface of the central body 4 on which the light sources 2 are attached.

Figure 1B:
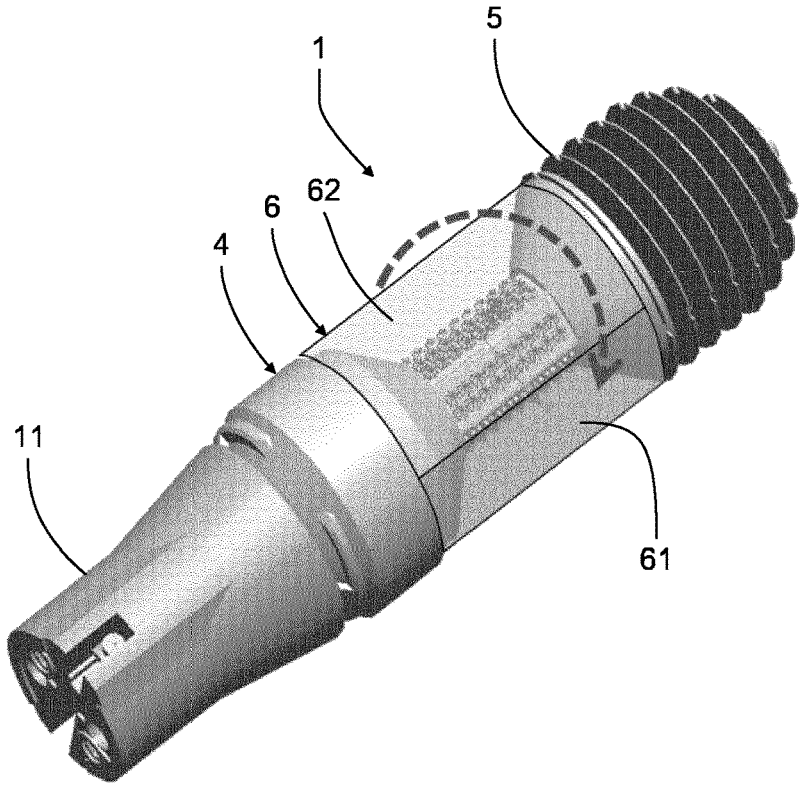
FIG. 1*b* is a perspective view of the lighting module provided with an optical element and connected to the socket.

FIG. 1*b* show lighting module 1 of FIG. 1*a* provided, according to the invention, with an optical element 6 rotatable about the longitudinal axis LA in relation to the central body 4. The optical element 6 includes an optical portion 61 having a deflecting property, such that the optical portion 61 is configured to deflect light emitted from at least one of the light sources 2 in a plane perpendicular to the longitudinal axis LA. The optical portion 61 extends in an angular area of about 60° around the longitudinal axis. In the present embodiment, the optical portion 61 has a constant cross section all along the longitudinal axis LA. The optical element 6 comprises a cover portion 62 adjacent to the optical portion 61. The optical element 6, including the cover portion 62, extends all around the central body 4 in a plane perpendicular to the longitudinal axis.

Figure 2A:
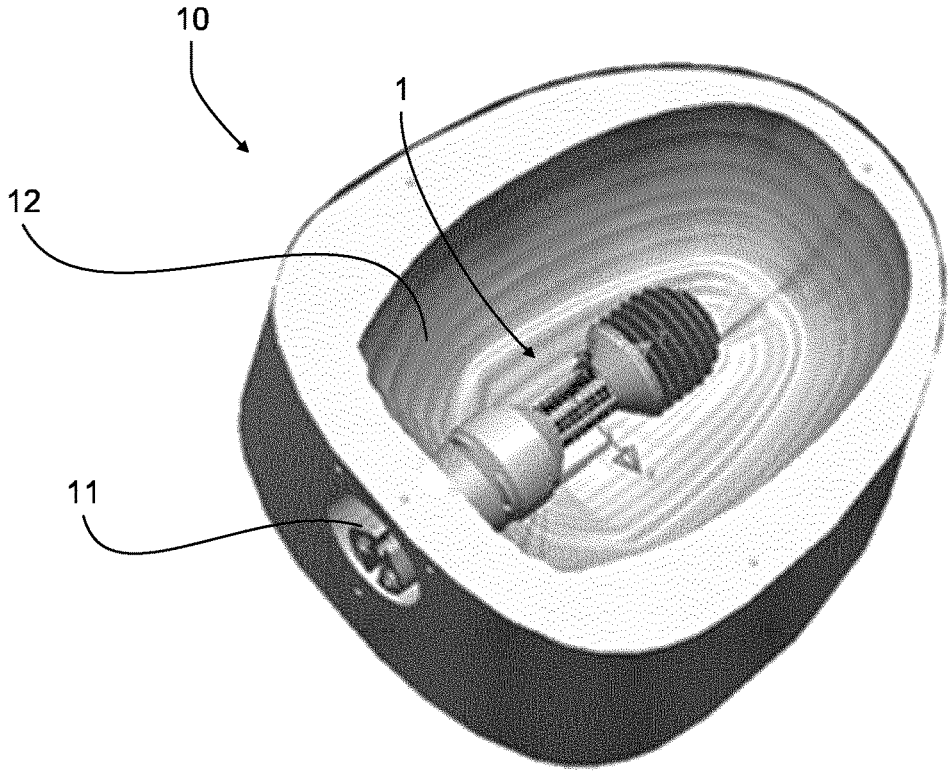
FIG. 2*a* is a perspective view of the lighting module and the socket the latter being fitted in a luminaire.

FIG. 2*a* shows the lighting module 1 which is mounted in a luminaire 10 provided with the socket 11 and a reflector 12, where the longitudinal axis LA is oriented in a similar way as in FIG. 1*a*. The longitudinal axis LA coincides with the optical center of the reflector 12.

Figure 2B:
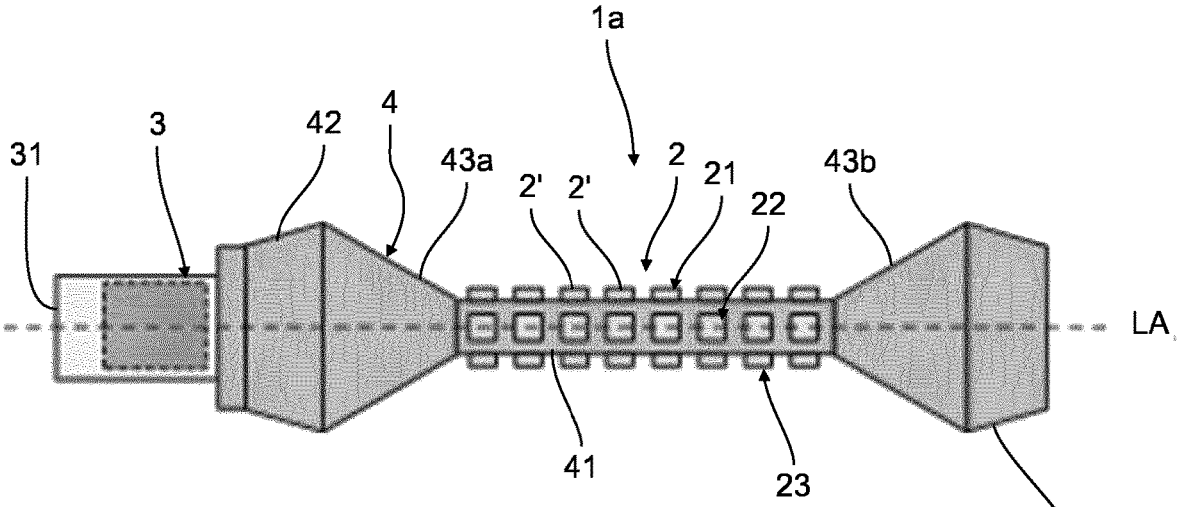
FIG. 2*b* is a schematic side view perpendicular to the longitudinal axis of a lighting module omitting the optical element.

FIG. 2*b* shows a schematic side view of a lighting module 1*a* perpendicular to the longitudinal axis LA. The lighting module 1*a* comprises the same elements as mentioned in relation to the lighting module 1 shown in FIG. 1 and the base 3 is shown connected to the thick portion 42 of the central body 4. In this embodiment however only four light sources 2 are indicated along the periphery of the slender portion 41 (three light sources 21, 22, 23 are visible in the figure). Each of the light sources 2 are shown to comprise one row of eight sub light sources 2' (not all marked with reference numbers), here in the form of single LEDs.

Figure 3A:
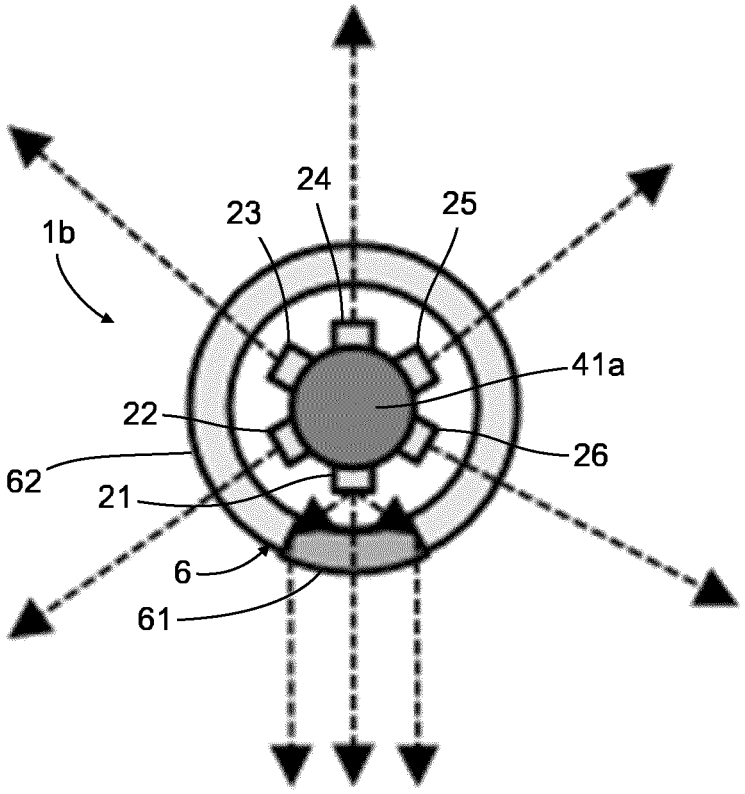
FIG. 3*a* is a schematic cross-sectional view of a lighting module with six light sources fitted on a round heat sink.

FIG. 3*a* shows a schematic cross-section of a lighting module 1*b* in a plane, shown as I-I in FIG. 1*a*, perpendicular to the longitudinal axis LA at the slender portion 41 of the central body 4. The lighting module 1*b* is similar to the lighting module 1 of FIG. 1*b*, except that the slender portion 41*a* has a round cross-section instead of a hexagonal cross-section. The slender portion 41*a* carries six light sources 21, 22, 23, 24, 25, 26. The main direction of light for each light source is substantially perpendicular to the surface of the slender portion 41*a* at the place where the respective light source is attached. The optical element 6 includes the optical portion 61 and the cover portion 62, and extends all around the slender portion 41 of the central body 4. The optical portion 61 is positioned to deflect light emitted from at the first light source 21. The deflected rays of light from the first light source 21 are parallel. The cover portion 62 substantially does not affect the emission of the light from the remaining light sources 22, 23, 24, 25, 26.

Figure 3B:
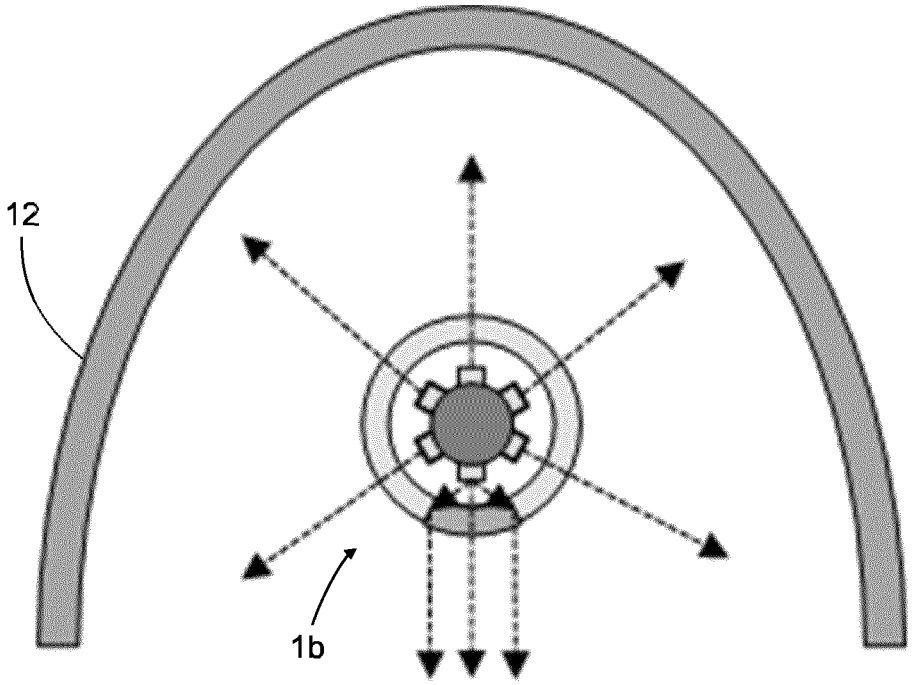
FIG. 3*b* is a schematic cross-sectional view similar to FIG. 3*a* showing the lighting module in a reflector.

FIG. 3*b* schematically shows the lighting module 1*b* of FIG. 3*a* installed in a luminaire of which only the reflector 12 is shown. The lighting module 1*b* is installed such that the longitudinal axis LA coincides with the optical center of the reflector 12.

Figure 4A:
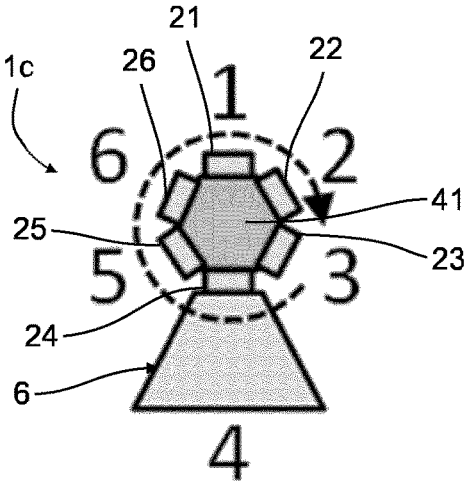
FIG. 4*a* is a schematic cross-sectional view showing a first arrangement of a lighting module with a rotatable optical element.

FIG. 4*a* show a schematic cross-section of a lighting module 1*c*. In this embodiment, the slender portion 41 of the central body 4 has the hexagonal cross-section of the embodiment of FIGS. 1*a* and 1*b*. The optical element 6 is rotatable about the longitudinal axis in relation to the central body 4 and includes one optical portion 61. The optical element 6 is in a position where the optical portion 61 deflects light emitted from the fourth light source 24.

Figure 4B:
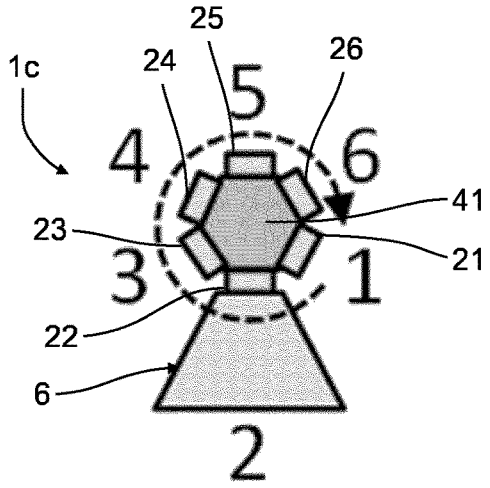
FIG. 4*b* is a schematic cross-sectional view illustrating a second arrangement of the lighting module of FIG. 4*a;*

FIG. 4*b* shows the same lighting module 1*c* as FIG. 4*a*, but compared to FIG. 4*a* the optical element 6 is rotated 120° clockwise to a position where the optical portion 61 deflects light emitted from the second light source 22 instead of the fourth light source 24.

Figure 4C:
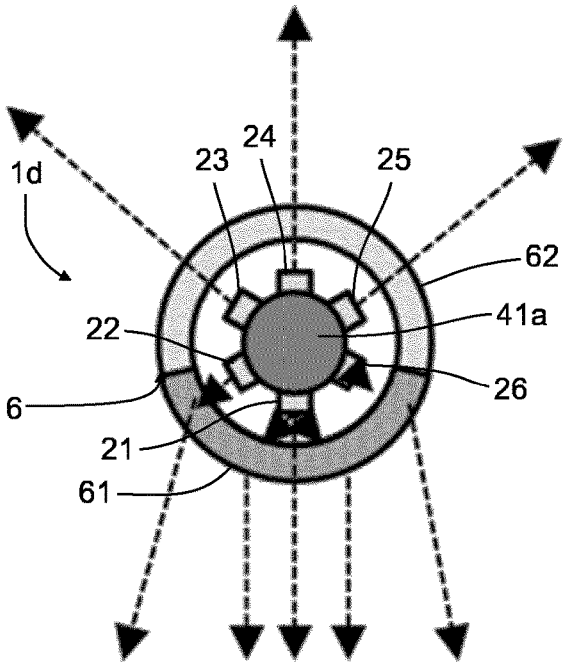
FIG. 4*c* is a schematic cross-sectional view of a lighting module with an optical element wherein the optical portion affects light from three light sources.

FIG. 4*c* shows a lighting module 1*d* similar to the lighting module 1*b* shown in FIG. 3*a*. In this embodiment shown in FIG. 4*c* however, the optical portion 61 of the optical element 6 extends in an angular area of about 150°. The optical portion 61 has a deflection and a collimation property, such that the optical portion 61 is configured to deflect light emitted from two of the six light sources, e.g. the second 22, and sixth light source 26, and to collimate the light emitted from one of the six light sources, e.g. the first light source 21. In this arrangement, the deflected light of the second 22 and of the sixth light source 26 are closer to parallel in relation to the light emitted from the first light source 21 after deflection than before deflection. The light emitted from the first light source 21 is collimated such that it is substantially parallel upon exiting the optical portion 61.

Figure 4D:
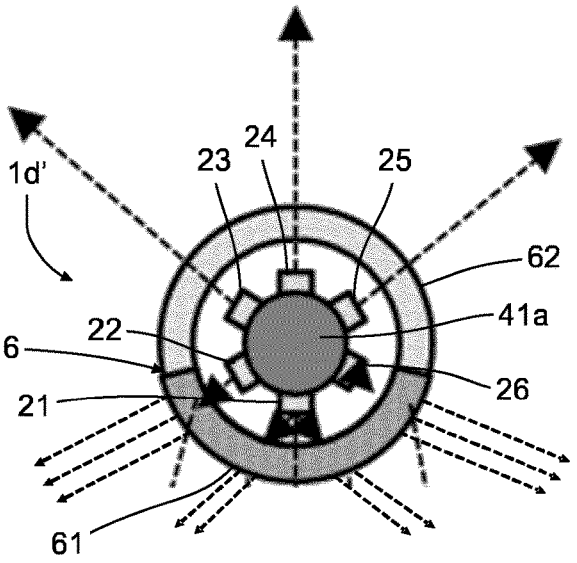
FIG. 4*d* is a schematic cross-sectional view of a lighting module with an optical element wherein the optical portion affects light from three light sources.

FIG. 4*d* shows a lighting module 1*d'* similar to the lighting module 1*d* shown in FIG. 4*c*. In this embodiment shown in FIG. 4*d*, the optical portion 61 has a deflection and a collimation property, such that the optical portion 61 is configured to deflect light emitted from one of the six light sources, e.g. the first light source 21, and to collimate light emitted from two of the six light sources, e.g. the second 21, and the sixth light source 26. In this arrangement, the light emitted from the first light source 21 is split in two directions after being deflected by the optical portion 61, wherein one direction is more or less parallel to the collimated light from the second source 22, and another direction is more or less parallel to the collimated light from the sixth light source 26.

Figure 5A:
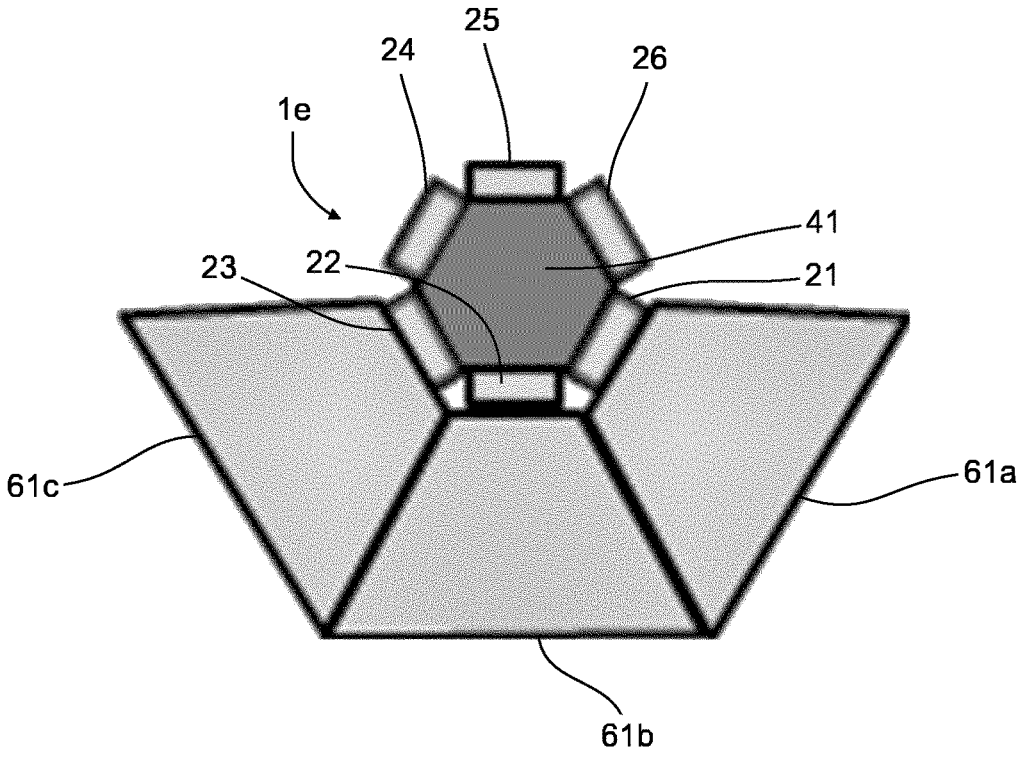
FIG. 5*a* is a schematic cross-sectional view similar to FIG. 4*a* of a lighting module wherein three optical portions each affects light from a different light source.

FIG. 5*a* show a lighting module 1*e* similar to FIG. 4*a*. In this embodiment, the optical element 6 comprises a first 61*a*, a second 61*b*, and a third optical portion 61*c*. Each optical portion 61*a*, 61*b*, 61*c* has a deflection property such that each optical portion 61*a*, 61*b*, 61*c* is configured to deflect light emitted from one light source, e.g. the first 21, second 22, and third light source 26, respectively. Accordingly, the optical element 6 will deflect light from three of the six light sources.

Figure 5B:
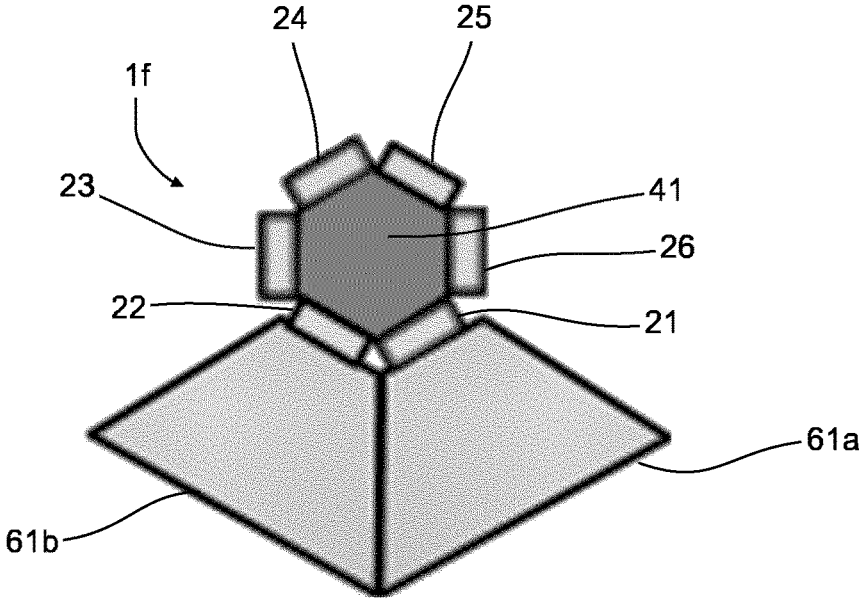
FIG. 5*b* is a schematic cross-sectional view similar to FIG. 4*a* of a lighting module wherein two optical portions each affects light from different light sources.

FIG. 5*b* show a lighting module 1*f* similar to FIG. 4*a*. In this embodiment, the optical element 6 comprises a first 61*a*, and a second optical portion 61*b*. Each optical portion 61*a*, 61*b* has a deflection property such that each optical portion 61*a*, 61*b*, 61*c* is configured to deflect light emitted from one light source, e.g. the first 21 and second light source 22, respectively. Accordingly, the optical element 6 in this embodiment will deflect light from two of the six light sources.

Figure 6A:
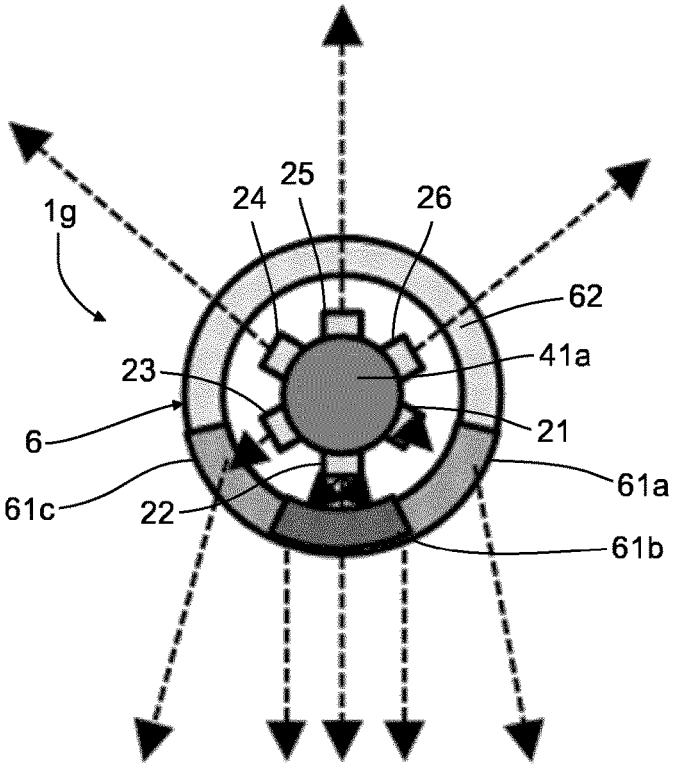
FIG. 6*a* is a schematic cross-sectional view similar to FIG. 4*c* of a lighting module wherein three different optical portions affect light from light sources.

FIG. 6*a* shows a lighting module 1*g* similar to FIG. 4*c*. In this embodiment, the optical element 6 comprises a first 61*a*, a second 61*b*, a third optical portion 61*c*, and a cover portion 62. Each optical portion 61*a*, 61*b*, 61*c* extends in an angular area of about 50°. Each optical portion 61*a*, 61*b*, 61*c* has a deflection property such that each optical portion is configured to deflect light emitted from one light source, e.g. the first 21, second 22, and third light source 26, respectively.

Figure 6B:
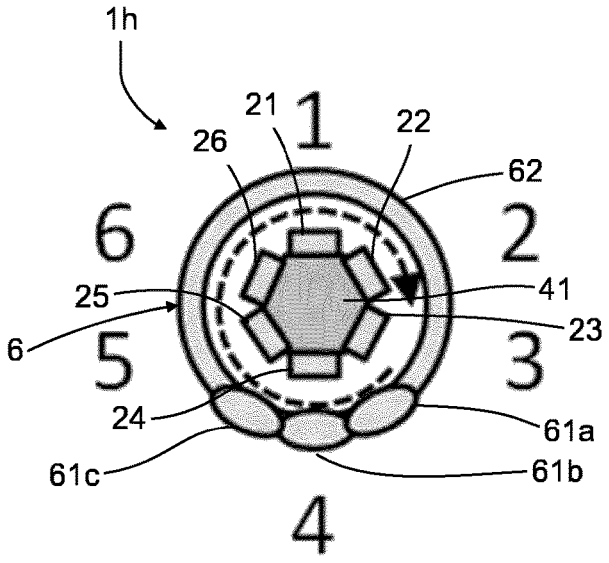
FIG. 6*b* is a schematic cross-sectional view similar to FIG. 4*a* of a first rotational arrangement of a lighting module including a rotatable optical element with three optical portions.

FIG. 6*b* show a schematic cross-section of a lighting module 1*h* similar to FIG. 4*a*. In this embodiment, the optical element 6 comprises a first 61*a*, a second 61*b*, a third optical portion 61*c*, and a cover portion 62. Each optical portion 61*a*, 61*b*, 61*c* extends in an angular area of about 30°. The optical element 6 is in a position where the optical portions 61*a*, 61*b*, 61*c* are configured to deflect light emitted from the fourth light source 24 and partly deflect light emitted from the third 23 and the fifth light source 25.

Figure 6C:
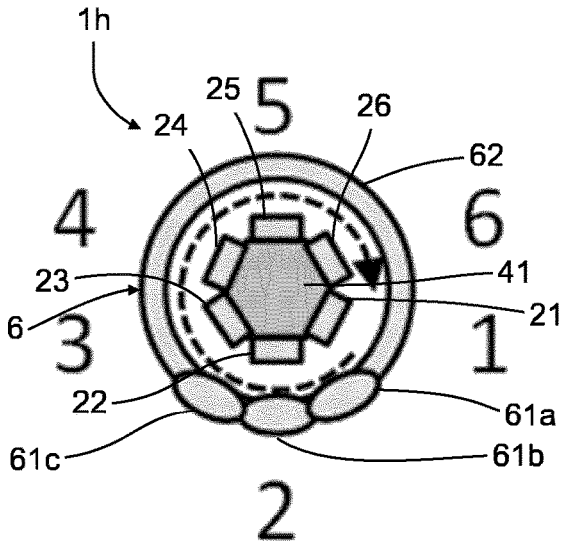
FIG. 6*c* is a schematic cross-sectional view similar to FIG. 6*b* of a second rotational arrangement of the lighting module.

FIG. 6*c* shows the same lighting module 1*h* as in FIG. 6*b*, where the optical element 6 is rotated 120° clockwise to a position where the optical portions 61*a*, 61*b*, 61*c* are configured to deflect light emitted from the second light source 22 and partly deflect light emitted from the first 21 and the third light source 23.

It should be understood that any of the lighting modules 1*a*, 1*b*, 1*c*, 1*d*, 1*d*', 1*e*, 1*f*, 1*g*, and 1*h* may be used like the module 1 in the luminaire 10 or another corresponding luminaire as shown in FIG. 2*a* and indicated in FIG. 3*b*. The latter shows the lighting module 1 is in a position in which the longitudinal axis is horizontal and the luminaire is positioned to emit light downwards. When the optical element 6 has a center of gravity displaced from the longitudinal axis LA and the optical element 6 is seated with a loose fit, gravity may rotate the optical element 6 around the longitudinal axis LA to the positions shown in FIGS. 3*a* and 3*b* to FIGS. 6*a* to 6*c*.

The luminaire 10 shown in FIG. 2*a* may be a luminaire constructed for e.g. a High Pressure Sodium (HPS) arc lamp. The lighting modules 1 to 1*h* may be used for retrofitting in the luminaire 10 whereby the rotational orientation of the lighting module after mounting in the socket 11 may be unknown. The light distribution of the light sources 2 carried by the central body 4 will be different from the light distribution of the light source of the gas-discharge lamp for which the luminaire 10 is designed and accordingly the light distribution of the lighting module 1 will not match the light distribution for which the luminaire 10 is constructed. According to the present invention this mismatch is compensated by the optical element 6 that is rotatable around the longitudinal axis LA to be positioned correctly in relation to the position of the lighting module 1 in the luminaire 10. The rotation of the optical element 6 to its correct position may either be achieved through gravity as mentioned above, or it may be effected manually after mounting the lighting module 1 in the luminaire 10, and provisions may be present for fixing the optical element 6 to the central body 4 to avoid that the optical element 6 rotates unintentionally from the intended position.

LIST OF REFERENCE NUMERALS

1, 1*a*, 1*b*,
1*c*, 1*d*,
1*d*', 1*e*,
1*f*, 1*g*, 1*h* lighting module
2 light source
21 first light source
22 second light source
23 third light source
24 fourth light source
25 fifth light source
26 sixth light source
2' sub light source
3 base
31 end of base
4 central body
41, 41*a* slender portion
42 thick portion
43 connecting portion
5 heat sink
6 optical element
61 optical portion
62 cover portion
LA longitudinal axis
10 luminaire
11 socket
12 reflector

The invention claimed is:

1. A lighting module for connecting to a luminaire, the lighting module extending along a longitudinal axis (LA) and comprising:

a base for connecting the lighting module to a socket of the luminaire;

a central body carrying at least a first light source and a second light source, wherein the first light source is configured to emit first light having a first light distribution with a first main direction pointing away from the longitudinal axis, and the second light source is configured to emit second light having a second light distribution with a second main direction pointing away from the longitudinal axis, the first and second main directions being different from one another; and an optical element including at least one optical portion and a cover portion extending all around the central body and said optical element being rotatable about the longitudinal axis (LA) in relation to the central body the at least one optical portion having an optical property, such that the optical portion is configured to affect light emitted from at least one of the light sources and to allow said affected light to be directly emitted from the optical element without passing through the cover portion, the at least one optical portion extends in an angular area around the longitudinal axis, and the cover portion is configured not to affect light emitted from the remaining light sources.

2. A lighting module according to claim 1, wherein the optical element comprises a plurality of optical portions each extending in different angular areas around the longitudinal axis and each having at least one optical property.

3. A lighting module according to claim 1, wherein each optical portion(s) of the optical element has at least one optical property chosen from the group of collimation, refraction, reflection, transparency, translucency, deflection, and diffraction.

4. A lighting module according to claim 1, wherein the at least one optical property of each optical portion is different from each other.

5. A lighting module according to claim 1, the cover portion is positioned adjacent to the optical portion(s) and extending in a second angular area around the longitudinal axis.

6. A lighting module according to claim 1, wherein the optical element, including the cover portion, extends all around the central body in a plane perpendicular to the longitudinal axis.

7. A lighting module according to claim 1, wherein the main directions of the light emitted from the light sources are in a plane, which is perpendicular to the longitudinal axis.

8. A lighting module according to claim 1, wherein the central body comprises a heat sink configured to transfer and dissipate heat from the light sources.

9. A lighting module according to claim 1, wherein the light sources are located at a distance from the longitudinal axis less than the maximum outer radius of the central body.

10. A lighting module according to claim 1, wherein the lighting module is configured to allow fixing the orientation of the optical element in relation to the central body.

11. A lighting module according to claim 1, comprising a number of light sources, each emitting light with a different main direction, said number being chosen from the group of 3, 4, 5 and 6.

12. A lighting module according to claim 1, wherein the optical element has a center of gravity displaced from the longitudinal axis.

13. A lighting module according to claim 1, wherein the optical portion(s) is/are configured to collimate light in a plane perpendicular to the longitudinal axis.

14. A luminaire comprising a socket and a lighting module according to claim 1, wherein the lighting module is connected to the socket.

15. A method for installing a lighting module according to claim 1 in a luminaire, comprising the steps of:

providing a luminaire with a socket and a lighting module, connecting the base of the lighting module to the socket, adjusting the angular orientation of the optical element in relation to the central body to provide the desired light distribution by rotating the optical element around the longitudinal axis, and optionally fixing the orientation of the optical element in relation to the central body.

* * * * *